United States Patent [19]

Bott et al.

[11] Patent Number: 5,069,594

[45] Date of Patent: Dec. 3, 1991

[54] BOTTLE DEBAGGING AND FEEDING APPARATUS

[75] Inventors: Jerry A. Bott; Floyd W. Butler, both of Grand Rapids, Mich.

[73] Assignee: Ideas in Motion, Grand Rapids, Mich.

[21] Appl. No.: 523,479

[22] Filed: May 15, 1990

[51] Int. Cl.[5] ..... B65B 43/38

[52] U.S. Cl. ..... 414/412; 414/411; 414/416; 53/492; 53/381.1; 198/433; 83/176

[58] Field of Search ..... 414/411, 412, 416; 53/381 R, 381 A, 384, 55–58, 492; 198/347.3, 433; 83/170, 171, 175, 176

[56] References Cited

U.S. PATENT DOCUMENTS

| | | | |
|---|---|---|---|
| 2,575,220 | 11/1951 | Hiller | 198/433 |
| 2,587,959 | 3/1952 | Biner | 198/433 |
| 3,179,231 | 4/1965 | Craig | 198/433 |
| 3,926,322 | 12/1975 | Scott | 414/412 |
| 4,134,508 | 1/1979 | Burdett | 414/412 X |
| 4,143,479 | 3/1979 | Kingston | 414/412 X |
| 4,344,268 | 8/1982 | Wakamatsu | 83/176 X |
| 4,390,313 | 6/1983 | Hoehn | 414/412 |
| 4,457,123 | 7/1984 | Hoehn | 414/412 X |
| 4,672,872 | 6/1987 | Kuehnert | 83/171 |
| 4,732,256 | 3/1988 | Dorner | 198/433 X |
| 4,848,065 | 7/1989 | Bott | 53/48 |
| 4,929,141 | 5/1990 | Keesey et al. | 414/412 |

FOREIGN PATENT DOCUMENTS

| | | | |
|---|---|---|---|
| 42276 | 5/1910 | Austria | 83/175 |
| 39492 | 3/1977 | Japan | 414/412 |
| 226535 | 9/1989 | Japan | 414/412 |

*Primary Examiner*—Frank E. Werner
*Assistant Examiner*—Brian K. Dinicola
*Attorney, Agent, or Firm*—Warner, Norcross & Judd

[57] ABSTRACT

An apparatus for debagging and loading bagged bottles into a production stream is provided with a debagging station and a loading station. The debagging station includes a pair of bristle rollers to grasp the bag flap and a cutting mechanism to sever the flap from the bag and thereby expose the bottles. The loading station includes an infeed table, a take-off conveyor, and an indexing pusher for moving the bottles on the infeed table toward the take-off conveyor. A control system sequentially and repetitively activates the pusher to move the bottles onto the take-off conveyor and activates the take-off conveyor to accelerate the bottles into a production stream.

47 Claims, 5 Drawing Sheets

BOTTLE DEBAGGING AND FEEDING APPARATUS

BACKGROUND OF THE INVENTION

The present invention pertains to an apparatus for debagging bottles and feeding them into a production stream.

In the production of bottled goods, the bottles are often purchased in bagged lots which must be opened and fed seriatim into the production stream. A bagged lot is typically formed as a single layer of bottles which are arranged into a square or rectangular matrix. The grouped bottles are encased into a plastic bag, the open end of which has been closed by heat sealing or the like. The closing of the bag creates a sealed flap on one end.

Heretofore, the opening and feeding of the bagged lots of bottles has been conducted in labor intensive and inefficient ways. Generally, the bags have been opened by holding the flap and manually cutting the bags with a knife. Thereafter, the operator manually pulls the bag away from the array of bottles. As can be appreciated, the manual slicing of the bags is a slow and tedious task. Moreover, the operation poses not only a personal hazard to the worker, but also a risk of damaging the bottles.

Once the bottles have been removed from their bag, they are uniformly fed into the production stream. Typically the bottles are maintained in their rectangular array and successively advanced onto the production conveyor a row at a time. The feeding operation has primarily been accomplished through the use of a continuously moving conveyor belt or an indexing feeding mechanism.

In a conveyor feed system, the array of bottles is supported on a continuously moving horizontal feed belt. At all times, each of the bottles is urged toward the laterally driven production belt which directs the bottles into the production stream. Hence, as each row is removed by the production belt the next row is automatically moved forward for removal. However, during the remainder of the time the bottles are required to slide relative to the moving feed belt. Although, larger bottles may be adequately fed by this method, the smaller, less stable bottles have a tendency of tipping over and blocking the feeding process.

In an indexing feeding system, the bottles are supported on a feed table and advanced toward the production belt by a pusher member. The operation is controlled by a series of sensors which are mounted in the bed of the feed table at spaced intervals corresponding to the successive rows of bottles. By supporting the bottles on a flat, stationary table and containing the rear row of bottles with the pusher member, the blocking tendencies of the belt feeding arrangement are alleviated. However, because the operation is controlled by a series of sensors fixed to the feed table, it lacks versatility. In particular, these feeding mechanisms are specifically set up for a certain size bottle. The sensors must all be carefully moved and re-set to facilitate a change in the feeding of differently sized bottles. As can be readily appreciated, this task not only requires the time of a trained workman, but also results in a substantial amount of down time for the feeding mechanism.

SUMMARY OF THE INVENTION

The aforementioned problems are overcome in the present invention, wherein the bottles are easily and efficiently removed from their bags and fed into the production stream. More specifically, the present invention includes a debagging station and a loading station which are designed and coordinated to reduce the amount of manual operation.

The debagging step is accomplished by an assembly which comprises a pair of bristled rollers and a cooperating cutting mechanism. The rollers grasp the sealed flap on the bag and automatically pull it outwardly away from the bottles. With the end of the bag extended, the cutter mechanism slices open the bag without risk of damaging the bottles or injuring the operator.

The loading station includes a feed table adapted to accept the newly opened bottles in mass from the debagging station, a pusher bar, and a single sensor which all work in concert to feed any size bottle effectively and efficiently. The single sensor controls both the movement of the pusher bar and the movement of the take-off mechanism to feed the bottles into the production stream. This coordinated arrangement provides an unlimited versatility of properly feeding any size bottle into the production stream without adjustment. Moreover, by utilizing a stable, non-moving feed table and a containing rear pusher bar, the risk of toppling the bottles is essentially eliminated.

These and other objects, advantages, and features of the present invention will be more fully understood and appreciated by reference to the written specification and appended drawings.

DETAILED DESCRIPTION OF THE PREFERRED EMBODIMENT

Figure 1:
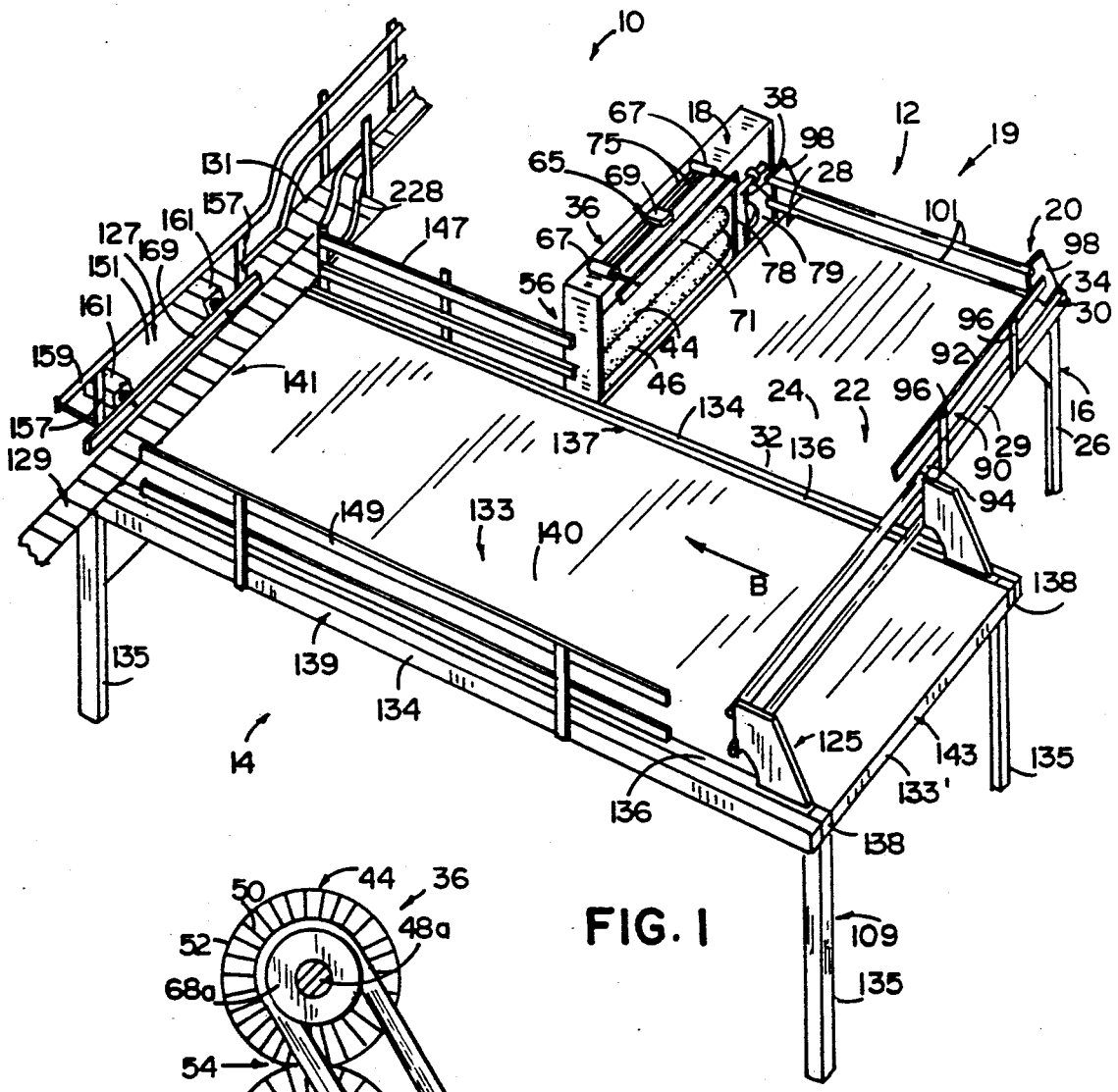
FIG. 1 is a perspective view of the debagging and loading apparatus.
Figure 3:
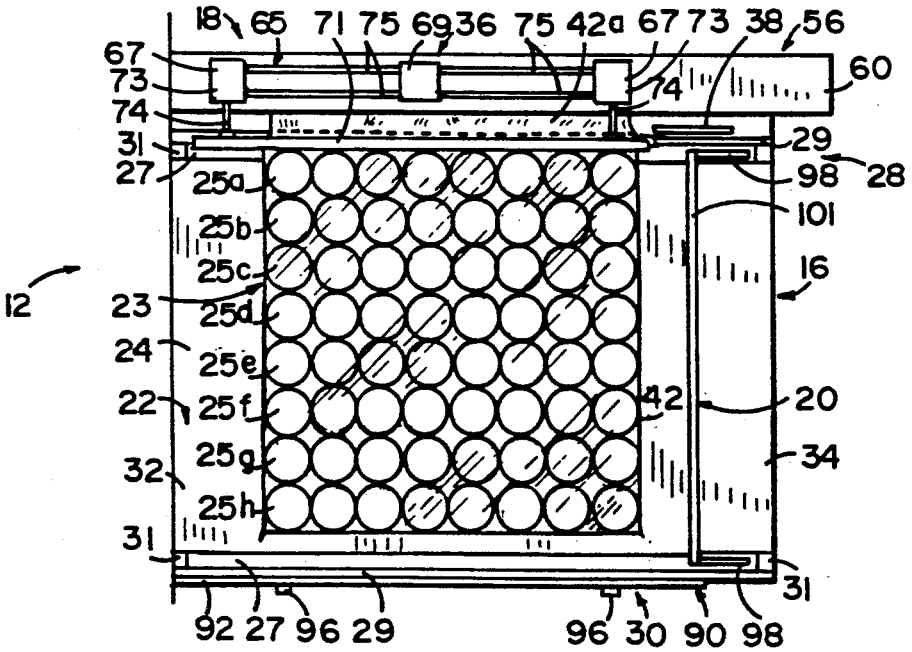
FIG. 3 is a top plan view of the debagging station of the apparatus.

In the preferred embodiment, the apparatus 10 includes a debagging station 12 and a loading station 14 (FIG. 1). The two stations are located adjacent one another so that coordinated action for feeding the bottles into the production stream can be achieved. The bottles 25 are generally supplied in bagged lots 23, which comprise a single layer of bottles arranged into a plurality of adjacent rows of bottles 25*a*–25*h* (FIG. 3). This array of bottles is encased in a closed plastic bag 42. Typically, one end of bag 42 is heat sealed such that a loose flap 40 is formed.

The debagging station 12 (FIGS. 1-7) includes a debagging table 16, a cutting mechanism 18 and a first pusher assembly 20. With little manual input, these elements cooperate to effectively remove the bag encasing the bottles and transport them to the loading station.

Debagging table 16 (FIGS. 1-3 and 7) includes a table top 22 defining an upper flat horizontal surface 24 on which the bagged lots 23 of bottles 25 are placed by the operator, and a plurality of upstanding legs 26 arranged in each corner thereof. Table top 22 is preferably rectangular in shape and defines first and second sides 28, 30 and forward and rearward ends 32, 34. Table top 22 further defines a pair of elongated gaps 27 along first and second sides 28, 30.

In the preferred construction, table top 22 includes a main body 22' having a pair of opposite sides 28', 30', and a pair of edge bars 29. Edge bars 29 are used to define gaps 27 for pusher assembly 20, as will be more fully described below. Edge bars 29 are narrow, elongated members which are mounted to sides 28', 30' in spaced, generally parallel orientations therewith. More specifically, each end of each bar 29 is spaced from one of the sides 28', 30' by spacer blocks 31. Conventional fasteners (not shown) are used to fasten the ends of bars 29 and blocks 31 to body 22'.

Figure 4:
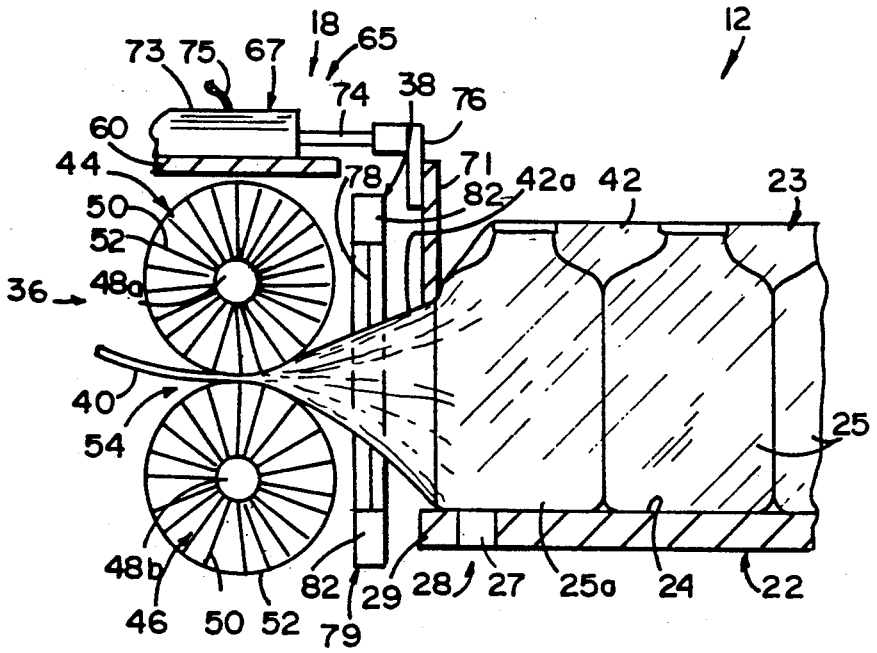
FIG. 4 is a cross-sectional view taken along line IV—IV in FIG. 3.

Cutting mechanism 18 (FIGS. 1-5 and 7) is positioned along first side 28 of table top 22, and includes a flap orienting device 36 and a cutter device 30. Flap orienting device 36 functions to lift the sealed flap 40 of bag 42 encasing the bottles 25, and pull the flap outwardly away from the bottles (FIG. 4). Once the flap has been extended in this manner, cutter device 30 is activated to slice the bag open for easy removal of the bottles 25 therefrom.

Figure 5:
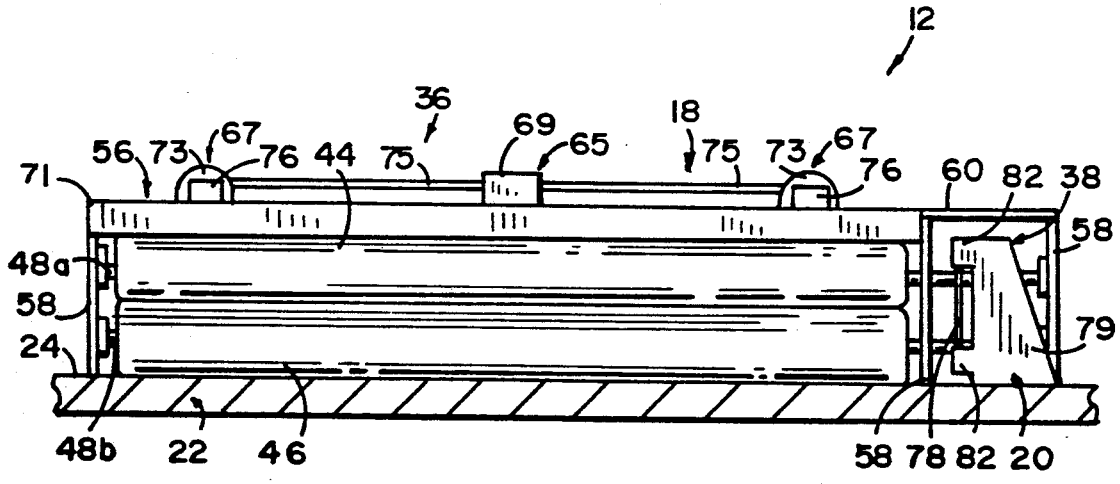
FIG. 5 is a cross-sectional view taken along line V—V in FIG. 3.

Flap orienting device 36 primarily includes a pair of opposed, horizontally oriented bristled rollers 44, 46 (FIGS. 1 and 4-5). Each roller 44, 46 includes an axle 48 and a plurality of closely aligned, radially extending bristles 40. Large numbers of equally sized bristles extend from each axle 48 so that no substantial gaps are presented along the peripheral ends 52 of bristles 50. As can be appreciated, ends 52 of bristles 50 collectively define the outer surfaces of rollers 44, 46. Preferably the bristles are composed of nylon, but could be composed of other materials. Rollers 44, 46 are vertically stacked such that only a small gap 54 is defined between the opposed adjacent ends 52 of the rollers' bristles 50. Rollers 44, 46 are mounted in a housing 56 including a plurality of upstanding spaced apart sidewalls 58 and an interconnecting top wall 60. Each of the sidewalls 58 are provided with a pair of bearing mounts (not shown) for rotatably securing the ends of axles 48*a*, 48*b*.

Figure 6:
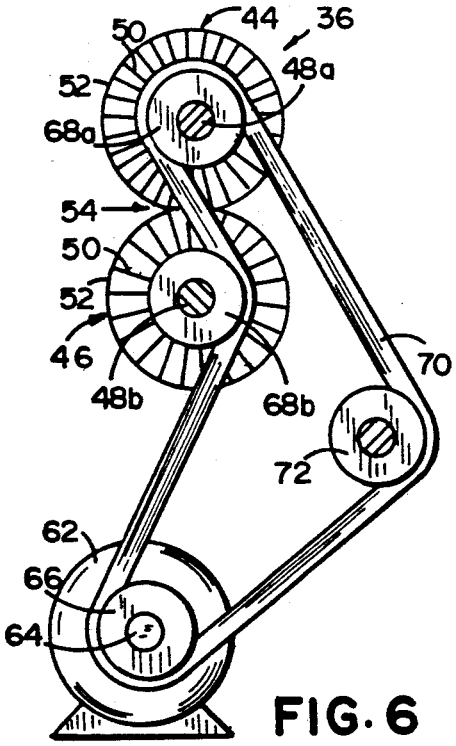
FIG. 6 is a cross-sectional view taken along line VI—VI in FIG. 3.

Rollers 44, 46 are collectively driven by a motor 62 (FIG. 6). Motor 62 is a conventional electric motor having a drive spindle 64 provided with a drive pulley 66. One end of each axle 48*a*, 48*b* extends through one of the sidewalls 58 to facilitate coupling of the axles with motor 62. In particular, each of the axles 48*a*, 48*b* includes a roller pulley 68*a*, 68*b* which is fixed to the axle in any conventional fashion for rotation therewith. Drive pulley 66 and roller pulleys 68*a*, 68*b* are generally aligned and operatively coupled together by a drive belt 70. Drive belt 70 is wrapped in a serpentine manner around the roller pulleys 68*a*, 68*b* so that each of the rollers 44, 46 rotate in opposite directions. More specifically, as shown in FIG. 6, the upper roller 68*a* is rotated in a counter-clockwise direction, while the lower roller 68*b* is rotated in a clockwise direction at the same speed. As will be described below, this arrangement urges the flap 40 of bag 42 into gap 54. To accommodate the vertical stacking of the rollers, an idler roller 72 is also included in the drive train. Preferably, idler roller 72 is adjustably mounted to facilitate replacement of the belt 70 and to remove any slack which may develop therein.

A debagging sensor 65 (FIGS. 1-5 and 7) is secured along top wall 60 of housing 56, and includes a pair of gas springs 67, a central control 69 and a sensor bar 71. Gas springs 67 are each comprised of a cylinder 73, a piston (not shown) and a projecting piston rod 74. Each of the springs 67 are fluidly coupled via conduit 75 to control 69. Control 69 supplies pressurized fluid to the springs and senses the movement of the pistons via conventional proximity sensors and wires (not shown). Sensor bar 71 is an elongated member positioned to extend between rollers 44, 46 and the first row of bottles 25*a* supported on table 16. Sensor bar 71 is fixed to the distal ends of rods 74 to be resiliently projected a certain distance from rollers 44, 46 in its rest position. Preferably, the sensor bar 71 is secured to springs 67 by a bracket 76 and conventional fasteners (not shown). As will be described more fully below, debagging sensor 65 cooperates with flap orienting device 36 and cutter device 38 to coordinate the movements of the two components for an efficient operation.

To achieve the removal of the bottles from bag 42, the operator places a bagged lot 23 of the bottles onto table top 22 such that flap 40 lies adjacent rollers 44, 46. The ends 52 of the rotating bristles 50 will engage the loose flap and direct it into and through gap 54 (FIGS. 3 and 4). Rollers 44, 46 additionally pull the bag taut for easy and efficient cutting.

More specifically, as flap 40 is pulled through gap 54, bag 42 and bottles 25 are shifted towards rollers 44, 46. This shifting action causes the row of bottles adjacent the rollers to abut sensor bar 71 of debagging sensor 65 and shift bar 71 against springs 67 until the pistons thereof reach their most compressed positions. At this point, stoppage of the bottles occurs and is sensed by control 69, which in turn signals the cutter device 38. As can be seen in FIG. 4, stoppage of the bottles 25 tightly stretches the portion of the bag 42*a* positioned between the bottles and the moving rollers 44, 46 for an appropriate cutting operation. Sensor 65, therefore, performs the dual function of a top to prevent the bottles from progressing into the path of the cutter and of activating cutter device 38.

Cutter device 38 (FIGS. 1, 4-5, and 7) is comprised of a hot cutting wire 78, a cutting base 79, a rodless cylinder 80, and a track 81. Cutting base 79 is essentially a planar, upright C-shaped member having a pair of spaced apart horizontal arms 82 between which cutting wire 78 is tightly strung. Rodless cylinder 80 is fixedly attached to the bottom of base 79 in any known manner, to achieve the lateral movement of the cutting wire 78. Rodless cylinder 80 is shaped to matingly engage track 81 for reciprocal movement therealong. Track 81 is located beneath table top 22 and is oriented to be substantially parallel to rollers 44, 46. The rodless cylinder and track are generally well known to those having ordinary skill in the control art. Examples of rodless cylinder driving systems which can be used are those of Tol-o-matic of Minneapolis, Minn., Model No. BL100-1P or Assembly No. 0910-0006. Of course, other rodless cylinders or other types of driving arrangements could be used. Cutting wire 78 is electrically heated in a conventional fashion so that the plastic bag 42 is quickly severed when contacted thereby. Additionally, cutting wire 78 is sufficiently long to cut through the entire portion of the bag 42*a* stretched between the first row of bottles 25*a* and rollers 44, 46. The cutting operation is performed by moving cutting wire 78 in a direction parallel to rollers 44, 46. The cutting motion is effected by rodless cylinder 80 being driven along track 81.

Once bag 42 has been completely cut open, the operator manually removes the bag from the bottles. More specifically, a split rail 90 is mounted to extend above the second side 30 of table top 22, opposite rollers 44, 46 (FIGS. 1–3 and 7). Split rail 90 preferably includes a pair of spaced apart rails 92, 94 securely attached to an edge bar 29 by a plurality of supports 96. To remove the bottles from the bag, the operator reaches through the rails 92, 94, grabs the end of the bag opposite the opened end, and manually pulls the bag away from the rollers 44, 46. The opening between the rails is smaller than the height of the bottles so that the bottles are held upon the table top 22 while the bag is pulled between the rails. Once the bag is completely removed, it is discarded.

At this point, the bottles 25 have been debagged and are now ready to be transferred to the loading station 14 for feeding into the production stream. Transferring the bottles to the loading station is accomplished through the use of a pusher assembly 20 (FIGS. 1–3 and 7).

Pusher assembly 20 includes a pair of side frames 98, pusher bars 101 and a drive construction 103 (FIGS. 1–3 and 7). Side frames 98 are vertically oriented plate members positioned within gaps 27 defined along each side of table top 22. Each side frame 98 includes an upper portion 105 which projects above upper surface 24 and a lower portion 107 which extends below table top 22. Pusher bars 101 are fixedly attached to the upper portion 105 of side frames 98 to extend completely across table top 22. Preferably two bars are used to engage upper and lower portions of the bottles so that a stable pushing arrangement is achieved. Upper portions 105 are generally arcuate in shape so that the pusher bars 101 are spaced forwardly of the sections of the frame members 98 extending through gaps 27. This construction permits all of the bottles to be moved onto loading station 14, as described more fully below. Of course other pushing constructions could be used. Lower portion 107 is operatively coupled to the drive construction 103 for effectively moving the pusher bars 101 back and forth across the table top.

Figure 7:
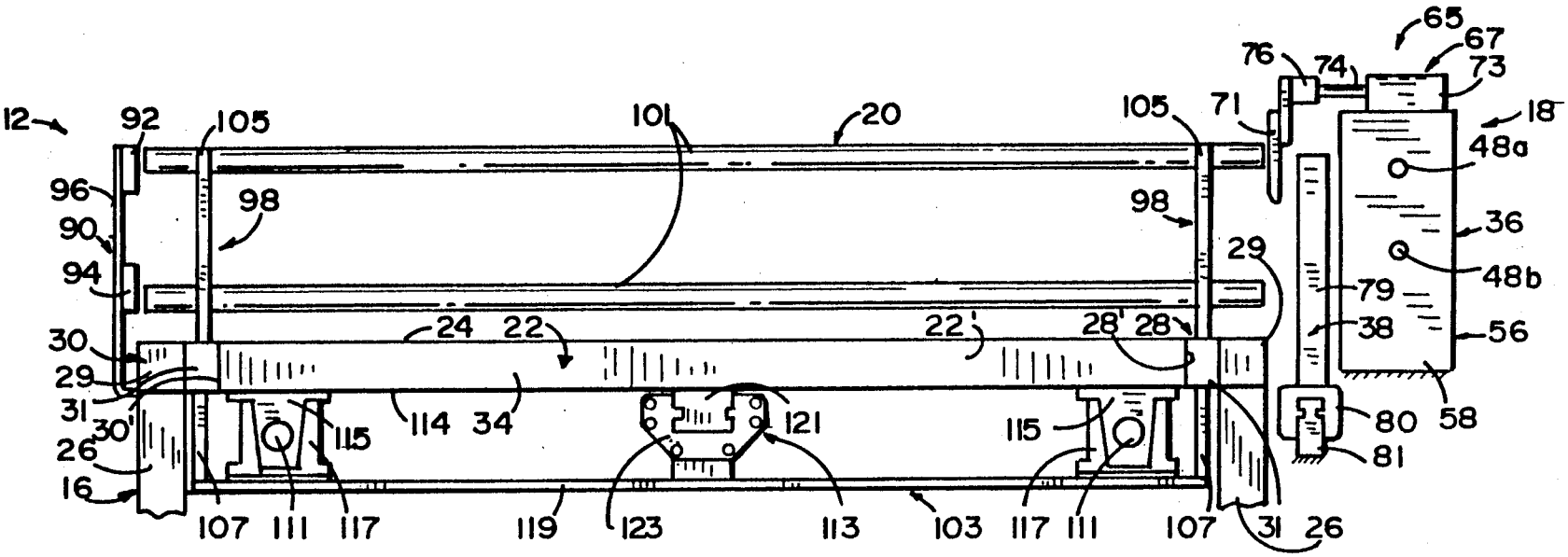
FIG. 7 is a fragmentary end elevational view of the debagging station.

Drive construction 103 (FIG. 1) is oriented below table top 22 and includes a pair of guide rods 111 and a central fluid driving system 113 (FIG. 7). More specifically, each guide rod 111 is attached to the underside 114 of table top 22 adjacent sides 28, 30 by a mount 115. A bearing 117 is slidably mounted for reciprocal movement along each of the guide rods 111. Bearings 117 are secured to a bridging plate 119 which extends below table top 22 between the two guide rods 111. Additionally, each end of the bridging plate 119 mounts and supports the upwardly projecting side frames 98 supporting pusher bars 101. Centrally mounted between bridging plate 119 and the underneath surface 114 of table top 22 is the fluid driving system 113.

In the most preferred embodiment, driving system 113 is comprised of a rodless fluid cylinder 123 matingly received onto a track 121. As mentioned above, these types of rodless cylinders are generally well known to those having ordinary skill in the control art. Suffice to say, cylinder 123 will be reciprocally moved along track 121 through the use of pressurized air. Of course other types of driving arrangements such as a drive screw could be used.

In any event, cylinder 123 is securely attached to bridging plate 119 while track 121 is attached to the underside 114 of table top 22. Hence, as cylinder 123 is moved along track 121 by the pressurized air, bridging plate 119 moves therewith along guide rods 111. Similarly, side frames 98 are moved along with bridging plate 119 to cause the desired movement of pusher bars 101.

In operation, pusher bars 101 are positioned along the rearward end 34 of table top 22 in their rest position. In this orientation, the operator places the bagged lots of bottles onto the table top 22 and removes the bag therefrom as described above. Once the bag is completely removed, the pusher assembly 20 is activated by the operator such that it moves toward the forward end 32 of table top 22. This movement causes pusher bars 101 to engage the line of bottles positioned adjacent rearward end 34 and push the entire array of bottles in mass across the table 16 in the direction indicated by arrow A. The bottles are laterally contained during the pushing operation by split rail 90 and sensor bar 71. The forward orientation of pusher bars 101, as compared to lower portion 107 of side frames 98, ensures that all of the bottles will be completely received onto the loading station 14 despite the fact that gaps 27 stop short thereof. Once the drive construction 103 has driven the pusher bars all the way across the table to push the bottles 25 onto loading table 109 the pressurized air is reversed to return the side frames 98 and pusher bars 101 to their rest position at the rearward end 34 of table top 22.

Figure 2:
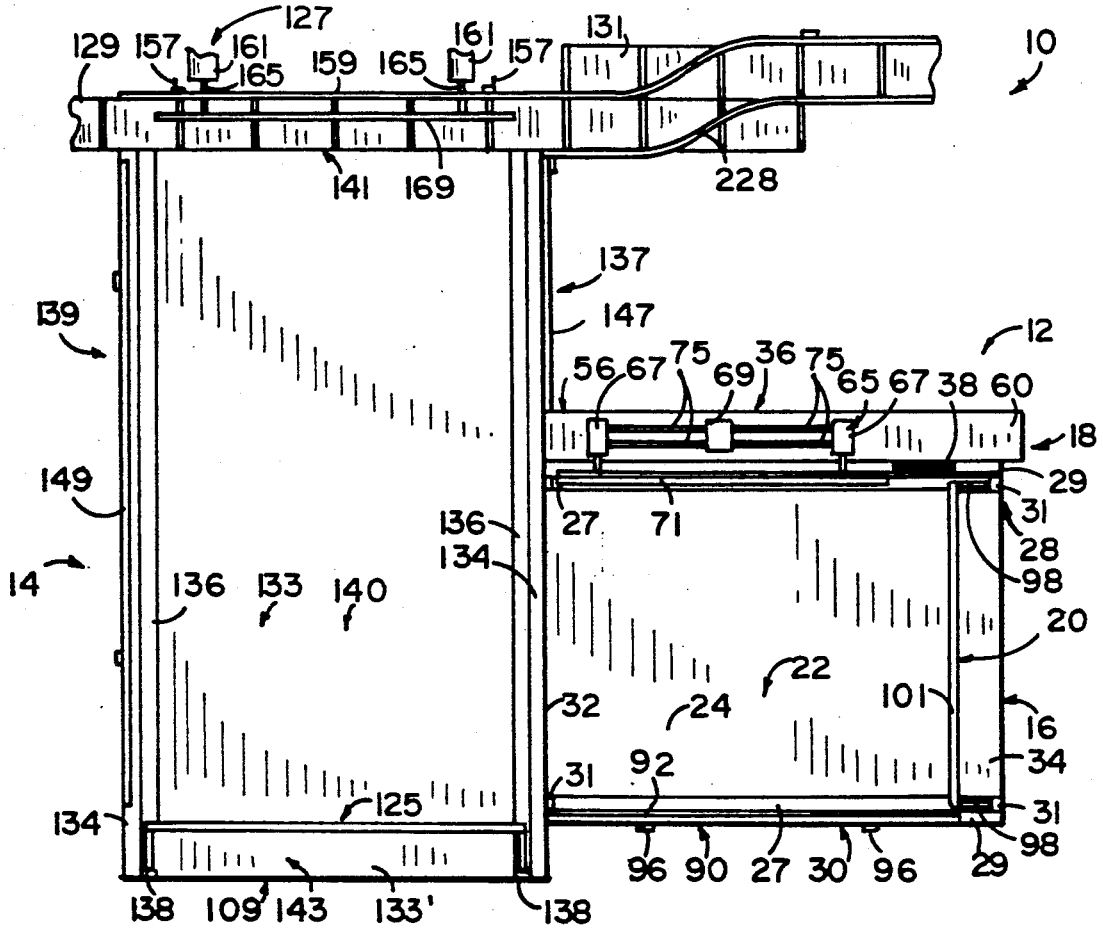
FIG. 2 is a top plan view thereof.

Loading station 14 includes an elongated loading table 109, a pusher device 125, a loading sensor 127, and a take-off conveyor 129 (FIGS. 1 and 2). Loading station 14 is adapted to receive groups of bottles 25 from debagging station 12 and feed them seriatim onto the feed conveyor 131 for use in the production stream.

In particular, loading table 109 includes an elongated table top forming a feed bed 133 and a plurality of upstanding legs 135. Feed bed 133 defines first and second sides 137, 139 and forward and rearward ends 141, 143. Also, as with table top 22 of debagging table 16, feed bed 133 includes a main body 133' and a pair of outside edge bars 134. Edge bars 134 extend along the entire length of sides 137', 139' of body 138' in a spaced apart relation to form a pair of elongated gaps 136. Each edge bar 134 is secured in place by passing conventional fasteners (not shown) through edge bars 134 and spacer blocks 138.

In the preferred embodiment, forward end 32 of debagging table 16 abuts contiguously against a portion of the first side 137 of loading table 109. The upper surface 140 of feed bed 133 is generally coplanar with upper surface 24 of table top 22, so that the bottles 25 are moved smoothly from table 16 to table 109. Rails 147, 149 are positioned along the length of second side 139 and the portion of first side 137 not abutted by table 16, to contain the bottles and keep them from falling from the feed bed 133.

Pusher device 125 is essentially the same construction as pusher assembly 20 for debagging station 12. More specifically, pusher device 125 includes a pair of side frames 98', pusher bars 101' extending across the width of loading table 109, and a driving system 113'. Likewise the driving system 113' is comprised of a pair of guide bars 111' extending along the entire length and underneath feed bed 133, a bridging plate 119', a rodless fluid cylinder 123', and a central track 121'. In the most preferred embodiment, the rodless cylinder 123' for loading station 14 is preferably of the type including a brake means, so that the incremental movement of the bottles to be described below can be more accurately controlled.

Loading sensor 127 (FIGS. 1-2 and 8-10) is positioned at the forward end 141 of loading table 109. Loading sensor 127 senses when the bottles need to be moved forwardly by pusher member 125, and when the forward row of bottles are properly positioned on take-off conveyor 129 for feeding into the production stream.

Loading sensor 127 (FIGS. 8-10) includes an L-shaped bracket 151 having a horizontal mounting leg 153 and a vertical mounting leg 155. Mounting leg 155 is preferably fixed to a pair of upstanding supports 157 which also support crossbar 159 to act as a forward barrier at the forward end 141 of loading table 109.

A pair of spaced apart bearing blocks 161 are fixedly mounted along the upper surface of supporting leg 153. Each bearing block 161 defines a central aperture 163 through which a rod 165 is reciprocally supported. Each rod 165 is oriented in a substantially parallel relationship to loading table 109. The first ends 167 of rods 165 face toward pusher member 125 and are interconnected by a sensor bar 169. Sensor bar 169 extends across substantially the entire width of loading table 109, and is positioned on the feed bed side of supports 157. As will be discussed below, sensor bar 169 is engaged by the bottles 25 to sense their various movements. The second ends 171 of rods 165 are interconnected by a biasing bar 173. Biasing bar 173 couples rods 165 to a biasing means 175 which urges the sensor bar 169 out over take-off conveyor 129.

Figure 8:
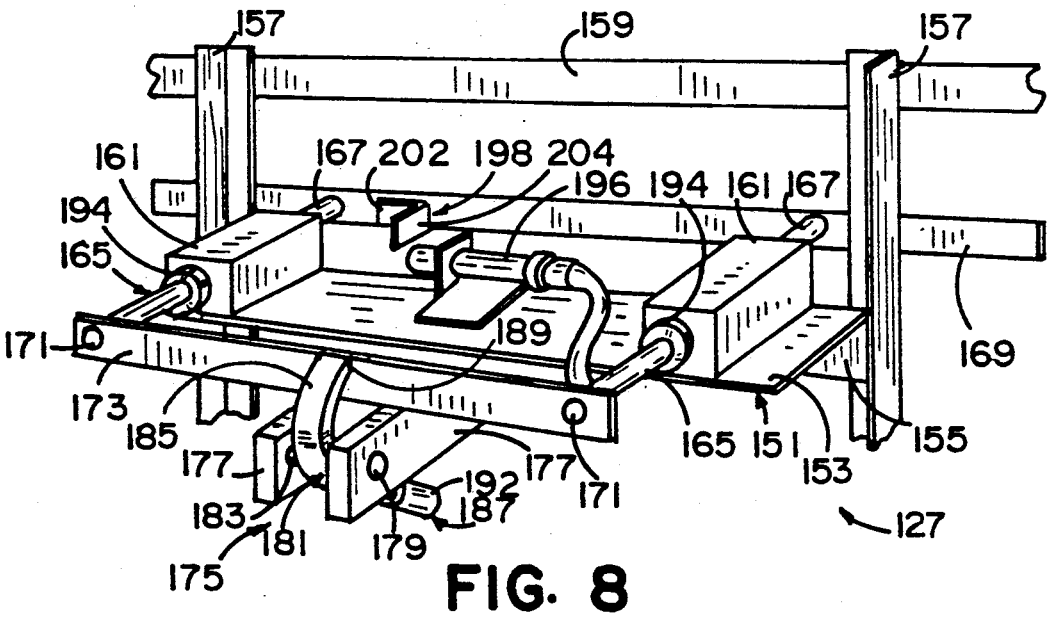
FIG. 8 is a perspective view of the loading sensor.
Figure 9:
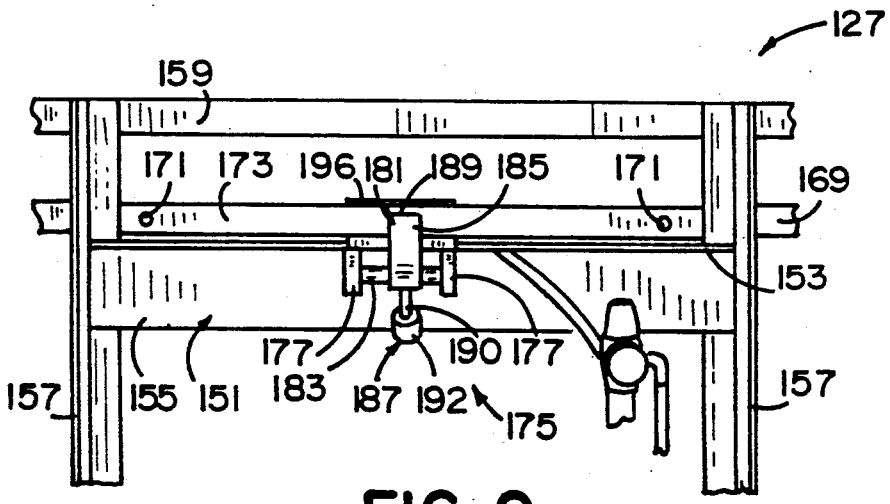
FIG. 9 is a rear elevational view of the loading sensor.

Biasing means 175, in the preferred embodiment, includes a pair of spaced apart braces 177 which project outwardly from supporting leg 153 in a direction away from loading table 109. A pivot pin 179 is secured between the distal ends of braces 177 for the pivotal mounting of biasing member 181. Biasing member 181 includes a bearing sleeve 183 rotatably received over pivot pin 179, an arcuate finger 185, and a biasing weight 187. Finger 185 extends upwardly from sleeve 183 and is adapted to engage the biasing bar 173 with its free end 189. The biasing weight 187 extends oppositely from sleeve 183 at such an angle that finger 185 is urged to move clockwise (as shown in FIG. 8). The biasing weight 187 preferably includes a slender rod 190 and an adjustable weighted knob 192 which is secured to the rod through the use of a set screw or the like. Adjustment of knob 192 permits the operator to adjust the biasing force provided by the biasing means 175.

In use, the biasing weight 187 urges finger 185 clockwise (as seen in FIG. 8) so that its free end 189 pushes against biasing bar 173. The force of finger 185 on biasing bar 173 moves rods 165 through bearing blocks 161 so that sensor bar 169 is extended over the take-off conveyor 129. Preferably stops 194 are adjustably mounted on rods 165 to abut the ends of bearing blocks 161 and set the position of sensor bar 169 in its rest position.

Figure 10:
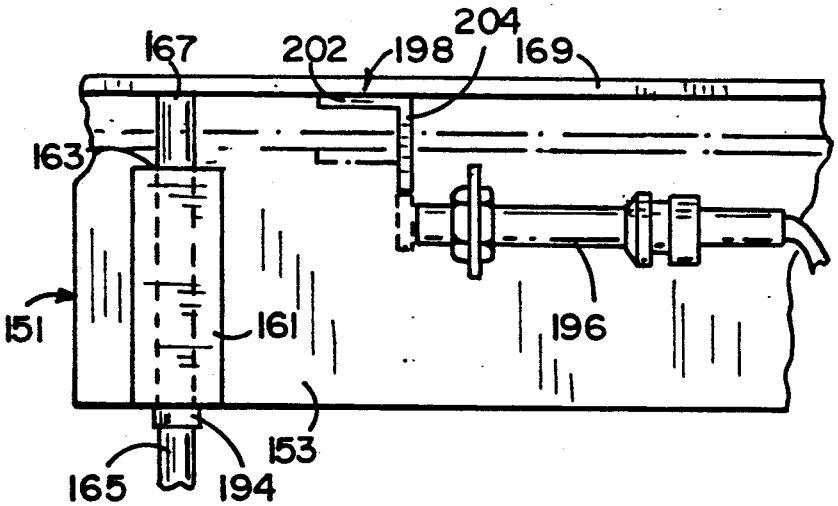
FIG. 10 is a fragmentary top plan view of the loading sensor.

Loading sensor 127 further includes a sensor element 196 and a complimentary sensing plate 198 (FIGS. 8 and 10). Sensing plate 198 is an L-shaped member having one arm 202 attached to the inside surface of sensor bar 169 and a projecting arm 204 projecting outwardly toward biasing bar 173. Sensor element 196 is preferably an optical sensor which is adapted to sense when arm 204 crosses in front of it. More specifically, when sensor bar 169 is not engaged with any bottles 25, and is biased outwardly by biasing weight 187, sensing arm 204 is positioned to the side of the optical sensor 196. However, when a row of bottles 25 engages sensor bar 169, it is moved backwardly against the force of biasing weight 187, until the bottles are completely placed upon take-off conveyor 129. In this position, arm 204 is juxtaposed to optical sensor 196 so that the sensor registers its presence. As will be discussed below, the sensing or not sensing of the arm 204 by optical sensor 196 controls the incremental advancement of the bottles 25.

Figure 11:
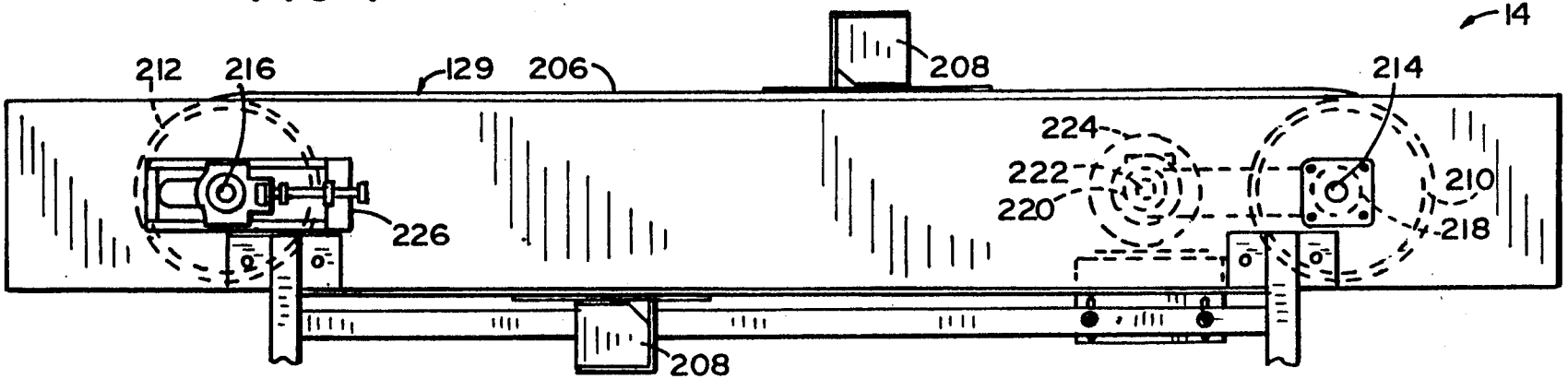
FIG. 11 is a side elevational view of the take-off conveyor of the apparatus.

Also at the forward end 141 of loading table 109 is the take-off conveyor 129 (FIGS. 1-2 and 11). Take-off conveyor 129 is positioned parallel to the feed conveyor 131 of the production stream and is designed to remove a row bottles at a time onto the feed conveyor. More specifically, take-off conveyor 129 (FIG. 11) includes an endless belt 206 upon which are mounted a plurality of take-off paddles 208. As is conventional, belt 206 is wrapped about a pair of spaced apart pulleys 210, 212 mounted upon axles 214, 216. Axle 214 further includes a sprocket 218 which is coupled to a drive sprocket 220 secured to the drive shaft 222 of a conventional air motor 224. Pulley 212 is an idler pulley which is adjustable through a conventional adjustment mechanism 226 to permit replacement of the belt and account for any slack which may develop therein.

Take-off conveyor 129 is not a continuously running conveyor, but rather is periodically actuated by loading sensor 127. In particular, when sensor bar 169 is pushed backwardly so that arm 204 is juxtaposed to optical sensor 196, take-off conveyor 129 is activated to move the row of bottles positioned thereon laterally from the loading table 109 and onto the feed conveyor 131.

Preferably, take-off conveyor 129 and feed conveyor 131 are arranged in a parallel relationship and in close proximity to one another (FIGS. 1 and 2). As the bottles are moved laterally off loading table 109 they engage an arcuate, generally S-shaped split guiding rail 228 which forces the bottles to move laterally relative to take-off conveyor 129 and onto feed conveyor 131 where it is moved into the production stream. Take-off paddles 208 are provided so that the bottles will positively move onto the feed conveyor and not begin to bunch when they engage guiding rail 228. Moreover, the guiding rail is positioned sufficiently high off the take-off conveyor 129 so that the paddles 208 can pass therebeneath. The paddles are positioned so that one is adapted to engage the end bottle on the next row to be taken off each time it is activated.

In the complete operation of the apparatus 10, an operator first manually takes a bagged lot 23 of bottles 25 and placed it on the upper surface 24 of debagging table 16, so that the sealed flap 40 of bag 42 is positioned adjacent the continuously rotating rollers 44, 46. The bristled rollers 44, 46 engage the flap 40 and direct it into the gap 54 defined therebetween. Once the flap has passed through the gap, the bag and bottles are pulled toward the rollers until the front row of bottles **25*a* engage the sensor bar 71 of debagging sensor 65. Sensor bar 71 stops the bottles once they are fully on take-off conveyor 129, which causes the end portion 42*a* of the bag to be stretched taut between rollers 44, 46 and the bottles 25*a*. Additionally, once sensor bar 71 has stopped the bottles, debagging sensor 65 signals the hot wire cutter 78** to pass laterally across the bag so that the bag is easily sliced open.

After the bag is opened, the operator then manually reaches through the split rail 90 and easily pulls the bag from the bottles. Once the bag has been removed, the operator manually activates pusher member 20 to push the group of bottles in mass, in the direction indicated by arrow A, from debagging table 16 to the loading table 109. Activation of pusher assembly 20 also moves pusher device 125 of loading station 14 to its rearward position adjacent end 143 to receive the newly opened bottles. Once all the bottles are pushed onto loading table 109, pusher assembly 20 returns to its rest position.

At this point loading sensor 127 is not engaged by any bottles, and therefore signals that the bottles should be advanced in the direction indicated by letter B. Pusher device 125 is activated to push the bottles in mass forwardly toward loading sensor 127 until the first row of bottles 25*a* engage and move sensor bar 196 until optical sensor 196 senses the juxtaposition of arm 204.

Loading sensor 127, then, stops the advance of the pusher device 125 and activates take-off conveyor 129 to remove the first row of bottles 25*a*. Once the last bottle and paddle have cleared the end of sensor bar 196, biasing weight 187 forces the sensing bar 169, through finger 185 and rods 165, outwardly again toward pusher device 125. This movement of sensor bar 169 moves the sensing arm 204 to the side of the optical sensor 196 which thereby activates, once again, the pusher device. Device 125 moves the bottles forwardly again, until the next forward row of bottles engages sensor bar 169 and activates the optical sensor as described above. In this way, nearly any size of bottle may be effectively and efficiently debagged and fed into the production stream through a minimum use of manual labor. In fact, the entire debagging and loading operation can be easily performed by a single operator.

The above description is that of a preferred embodiment of the invention. Various alterations and changes can be made without departing from the spirit and broader aspects of the invention as set forth in the appended claims, which are to be interpreted in accordance with the principles of patent law including the Doctrine of Equivalents.

The embodiments of the invention in which an exclusive property or privilege is claimed are defined as follows:

1. An apparatus for debagging and feeding items into a production stream, said apparatus comprising:

(a) a debagging system including:

(i) supporting means for supporting a collection of items encased within a bag having a sealed flap to close one end;

(ii) a pair of rollers positioned adjacent said supporting means;

(iii) means for driving said rollers in opposite directions such that said rollers direct the sealed flap on the bag to pass between said rollers and pull the flap to form a taut portion of the bag between said rollers and the items;

(iv) cutting means for cutting the bag between the flap and the items to thereby open the bag; and (v) first coordinating means for sensing when the portion of the bag is substantially taut and for activating said cutting means to cut the bag, said first coordinating means including a sensing bar and a cooperating control unit, wherein said sensing bar is engaged and moved from a first position to a second position by the items when said rollers pull the flap of the bag to create tautness in the bag, and wherein said sensing bar in said second position functions to stop the movement of the items and cooperate with said control unit to activate said cutting means to cut the bag;

(b) a loading system including:

(i) a feed bed adapted to receive a plurality of items thereon;

(ii) take-off means for periodic movements for removing at least one row of items at a time from said feed bed;

(iii) moving means for periodic movements for moving the items toward said take-off means so that the items can be thereby removed from said feed bed; and (iv) coordinating means for sensing and controlling the periodic movements of said take-off means and said moving means; and (c) transferring means for transferring the items from said supporting surface to said feed bed after the bag has been removed from the items.

2. An apparatus as defined in claim 1 wherein said rollers of said debagging system each include a plurality of radially extending bristles adapted to engage and direct the flap between said rollers.

3. An apparatus as defined in claim 2 wherein said cutting means includes a hot wire which is moved across the bag, between said rollers and the items, to open the bag.

4. An apparatus as defined in claim 3 wherein said rollers define a pair of rotational axes and said hot wire is oriented vertically and moved in a direction substantially parallel to said rotational axes.

5. An apparatus as defined in claim 1 wherein said cutting means includes a hot wire which is moved across the bag, between said rollers and the items, to open the bag.

6. An apparatus as defined in claim 1 further including an abutment defining an opening therethrough, said abutment being positioned adjacent said support means opposite said rollers so that an operator can reach through said opening and pull said bag through said opening and from the items after the bag has been opened, said opening being dimensioned and oriented such that the items abut said abutment and do not pass through said opening with the bag when it is pulled by the operator.

7. An apparatus as defined in claim 6 in which said transferring means includes a pusher member which is positioned adjacent said support means and is reciprocally movable for movement thereacross for transferring the items from said support means to said feed bed after the items are removed from the bag.

8. An apparatus as defined in claim 1 in which said transferring means includes a pusher member which is positioned adjacent said support means and is reciprocally movable for movement thereacross for transferring the items from said support means to said feed bed after the items are removed from the bag.

9. An apparatus as defined i claim 1 wherein said coordinating means includes sensor means for sensing first and second conditions, means for activating said moving means when said sensor means senses the first condition, and means for activating said take-off means when said sensor means sense the second condition to remove at least one item from said feed bed.

10. An apparatus for debagging and feeding items into a production stream, said apparatus comprising:

(a) debagging means for opening a bag of bagged items;

(b) a loading system including:

(i) a feed bed adapted to receive a plurality of items thereon;

(ii) take-off means for periodic movement to remove at least one row of items at a time from said feed bed;

(iii) moving means for periodic movement to move the items on said feed bed toward said take-off means so that the items can be removed from said feed bed; and (iv) coordinating means for sensing and controlling the periodic movements of said take-off means and said moving means, said coordinating means having the capacity to control said take-off means and said moving means in a coordinated manner for items of different sizes, said coordinating means including sensor means for sensing a first condition and a second condition, means for activating said moving means when said sensor means senses the first condition to move the items on said feed bed until said sensor means senses the second condition, and means for activating said take-off means when said sensor means senses the second condition to remove at least one item from said feed bed; and (c) transferring means for transferring the items from said debagging means to said feed bed after the items are removed from the bag.

11. An apparatus as defined in claim 10 wherein said first condition includes a time when at least one row of items is ready for removal from said feed bed by said take-off means, and said second condition includes a time when no items are ready for removal from said feed bed by said take-off means.

12. An apparatus as defined in claim 10 wherein said sensor means includes an element moveable between a first position and a second position and biasing means for biasing said element toward said first position, wherein said first condition is sensed when said element is in said first position, and wherein said second condition is sensed when said element is moved to said second position by at least one item moved by said moving means.

13. An apparatus as defined in claim 12 wherein said biasing means includes a biasing weight which is operatively associated with said element so that the force of gravity acting on said biasing weight biases said element into said first position.

14. An apparatus as defined in claim 12 wherein said coordinating means further includes an optical sensor which senses when said element is and is not in said second position.

15. An apparatus as defined in claim 12 wherein said moving means includes a reciprocal pusher member adapted to move the items across said feed bed and a rodless fluid cylinder driving device which has a positive brake to specifically lock said pusher member against movement when said element reaches said second position.

16. An apparatus as defined in claim 10 wherein said take off means includes a conveyor positioned to receive said items removed from said feed bed and to move said items laterally from said feed bed.

17. A debagging system comprising:

support means for supporting a collection of items encased within a bag having a sealed flap to close one end;

a pair of rollers positioned adjacent said support means;

means for driving said rollers in opposite directions such that said rollers direct the sealed flap on the bag to pass between said rollers and pull the flap to form a taut portion of the bag between said rollers and the collection of items;

cutting means for cutting the bag between the flap and the collection of items to thereby open the bag; and coordinating means for sensing when the portion of the bag is substantially taut and for activating said cutting means to cut the bag when said coordinating means senses the tautness in the bag, said coordinating means including a sensing bar and a cooperating control unit, wherein said sensing bar is engaged and moved from a first position to a second position by the collection of items when said rollers pull the flap of the bag to create the tautness in the bag, and wherein said sensing bar in said second position functions to stop the movement of the collection of items and cooperate with said control means to activate said cutting means to cut the bag.

18. A debagging system as defined in claim 17 wherein said rollers of said debagging system each include a plurality of radially extending bristles adapted to engage and direct the flap between said rollers.

19. A debagging system as defined in claim 17 wherein said cutting means includes a hot wire which is moved across the bag, between said rollers and the collection of items, to open the sealed bag.

20. A debagging system as defined in claim 19 wherein said rollers define a pair of rotational axes and said hot wire is oriented vertically and moved in a direction substantially parallel to said rotational axes.

21. A debagging system as defined in claim 17 further including an abutment defining an opening therethrough, said abutment being positioned adjacent said support means opposite said rollers so that an operator can reach through said opening and pull said bag through said opening and from the items after the bag has been opened, said opening being dimensioned and oriented such that the items abut said abutment and do not pass through said opening with the bag when it is pulled by the operator.

22. A degagging system as defined in claim 21 which further includes a transferring means for removing the items from said support means after the bag has been removed, a feed bed adapted to receive the collection of items from said support means, said transferring means including a pusher member which is positioned adjacent said support means and is reciprocally movable for movement thereacross for transferring the items from said support means to said feed bed after the items are removed from the bag.

23. A debagging system as defined in claim 17 which further includes a transferring means for removing the items from said support means after the bag has been removed, a feed bed adapted to receive the items removed from said support means, said transferring means including a pusher member which is positioned adjacent said support means and is reciprocally movable for movement thereacross for transferring the items from said supporting surface to said feed bed after the items are removed from the bag.

24. A debagging apparatus comprising:

a support adapted to receive and support at least one item encased within a bag having a sealed flap;

engaging means for pulling the flap outwardly away from the bag;

cutting means comprising a hot wire cutting element for cutting the bag adjacent the flap to open the bag; and coordinating means for coordinating said cutting means with the pulling of said engaging means, said coordinating means including sensor means for sensing when the flap is pulled away from the bag and means for activating said cutting means when said sensor means senses the pulling of the flap.

25. A debagging apparatus as defined in claim 24 wherein said engaging means includes a pair of oppositely rotated bristled rollers.

26. A debagging apparatus as defined in claim 24 wherein said coordinating means includes a sensor bar movable between first and second positions and bias means for biasing said sensor bar is said first position, wherein said engaging means pulls the bag against said sensor bar, when it pulls the flap, and moves said sensor bar to said second position, wherein said sensor bar stops said items when at said second position to create a taut portion in the bag between the flap and the items, and wherein said activating means activates said cutting means when said sensor is at said second position.

27. A debagging apparatus as defined in claim 28 further including removal means for holding at least one item on said support when the bag is removed from the item.

28. A degagging apparatus as defined in claim 27 in which said removal means includes an abutment opposite said engaging means, wherein said abutment defines an opening through which the bag can be pull from the at least one item, and wherein said abutment abuts the item and prevents the item from being pulled through said opening with the bag.

29. A loading system comprising:

a feed bed adapted to receive a plurality of items thereon;

take-off means for removing at least one item at a time from said feed bed;

moving means for moving the items on said feed bed toward said take-off means so that the items can be removed from said feed bed; and coordinating means for sensing and controlling the movements of said take-off means and said moving means, said coordinating means having the capacity to control said take-off means and said moving means in a coordinated manner for items of different sizes, said coordinating means including sensor means for sensing a first condition which includes a time when at least one item is ready for removal from said feed bed by said take-off means and a second condition which includes a time when no items are ready for removal from said feed bed by said take-off means, means for activating said moving means when said sensor means senses the first condition to move the items on said feed bed until said sensor means senses the second condition, and means for activating said take-off means when said sensor means senses the second condition to remove at least one item from said feed bed, said sensor means including an element moveable between a first position and a second position and biasing means for biasing said element toward said first position, wherein said first condition is sensed when said element is in said first position, and wherein said second condition is sensed when said element is moved to said second position by at least one item moved by said moving means.

30. A loading system as defined in claimed 29 wherein said biasing means includes a biasing weight which is operatively associated with said element so that the force of gravity acting on said biasing weight biases said element into said first position.

31. A loading system as defined in claim 29 wherein said coordinating means further includes an optical sensor which senses when said element is and is not in said second position.

32. A loading system as defined in claim 29 wherein said moving means includes a reciprocal pusher member adapted to move the items across said feed bed and a rodless fluid cylinder driving device which has a positive brake to specifically lock said pusher member against movement when said element reaches said second position.

33. A loading system as defined in claim 29 wherein said take-off means includes a conveyor positioned to receive said items removed from said feed bed and to move said items laterally from said feed bed.

34. A loading apparatus comprising:

a support adapted to receive and support a collection of items;

take-off means for removing at least one item at a time from said support;

moving means for moving the items on said support toward said take-off means; and coordinating means for coordinating said take-off means and said moving means, said coordinating means including sensor means for sensing a first condition when at least one item is ready to be removed by said take-off means and a second condition when no item is ready to be removed by said take-off means, said sensor means including a sensor mounted for movement between first and second positions and biasing means for biasing said sensor in said second position, wherein the second condition is sensed when said sensor is in the second position, wherein said first condition is sensed when said sensor is engaged by at least one item being moved by said moving means and moved to the first position, said coordinating means further including means for activating said take-off means to remove the at least one item when the first condition is sensed and for activating said moving means to move the item toward said take-off means when the second condition is sensed such that said moving means moves the items until the second condition is sensed irrespective of the distance said moving means moves.

35. A loading apparatus as defined in claim 34 in which said take-off means includes an endless conveyor adapted to remove all items which are supported thereon.

36. An apparatus for debagging and feeding items into a production stream, said apparatus comprising:

(a) a debagging system including:

(i) a supporting surface adapted to receive thereon an array of items encased within a bag having a sealed flap to close one end;

(ii) a pair of rollers positioned adjacent said supporting surface;

(iii) means for driving said rollers in opposite directions such that said rollers direct the sealed flap on the bag to pass between said rollers and pull said flap so that the bag is substantially taut between said rollers and the items; and (iv) cutting means for cutting the bag between the flap and the items to thereby open the bag for removal of the items from the bag;

(b) a loading system including:

(i) a feed bag adapted to receive a plurality of items thereon;

(ii) take-off means for periodically removing at least one item at a time from said feed bed;

(iii) moving means for periodically moving the items on said feed bed toward said take-off means so that the items can be removed from said feed bed; and (iv) coordinating means for sensing and controlling the periodic movements of said take-off means and said moving means, said coordinating means including an element movable between a first position and a second position and a biasing means for biasing said element toward said first position, said coordinating means activating said moving means when said element is in said first position to move the items towards said take-off means until at least one item moves said element to said second position, and said coordinating means activating said take-off means when said element is in said second position to remove at least one item from said feed bed; and (c) transferring means for transferring the items from said supporting surface to said feed bed after the items are removed from the bag.

37. An apparatus as defined in claim 36 which further includes a second coordinating means for sensing when the bag is substantially taut between said rollers and the items, and for activating the movement of said cutting means to cut the bag, wherein said second coordinating means includes a sensing bar and a cooperating control unit, wherein said sensing bar is engaged and moved from a first position to a second position by the items when said rollers pull the flap of the bag to create the tautness in the bag, and wherein said sensing bar in said second position functions to stop the movement of the items and cooperate with said control unit to activate said cutting means to cut the bag.

38. An apparatus as defined in claim 37 further including an abutment defining an opening therethrough, said abutment being positioned adjacent said supporting surface opposite said rollers so that an operator can reach through said opening and pull said bag through said opening and from the items after the bag has been opened, said opening being dimensioned and oriented such that the items said abutment and do not pass through said opening with the bag when it is pulled by the operator.

39. An apparatus as defined in claim 38 in which said transferring means includes a pusher member which is positioned adjacent said supporting surface and is reciprocally movable for movement thereacross for transferring the items from said supporting surface to said feed bed after the items are removed from the bag.

40. An apparatus for debagging and feeding items into a production stream, said apparatus comprising:

(a) a debagging system including:

(i) supporting means for supporting a collection of items encased within a bag having a sealed flap to close one end;

(ii) a pair of rollers positioned adjacent said supporting means;

(iii) means for driving said rollers in opposite directions such that said rollers direct the sealed flap on the bag to pass between said rollers and pull the flap; and (iv) cutting means for cutting the bag between the flap and the items to thereby open the bag;

(b) a loading system including:

(i) a feed bed adapted to receive a plurality of items thereon;

(ii) take-off means for periodic movements for removing at least one row of items at a time from said feed bed;

(iii) moving means for periodic movements for moving the items toward said take-off means so that the items can be thereby removed from said feed bed; and (iv) coordinating means for sensing and controlling the periodic movements of said take-off means and said moving means, said coordinating means including sensor means for sensing first and second conditions, means for activating said moving means when said sensor means senses the first condition, and means for activating said take-off means when said sensor means senses the second condition to remove at least one row of items from said feed bed;

(c) transferring means for transferring the items from said supporting surface to said feed bed after the bag has been removed from the items.

41. An apparatus as defined in claim 40 wherein said sensor means includes a reciprocal sensor bar which is movable between a first position corresponding to said first condition and a second position corresponding to said second condition, and wherein said coordinating means activates said moving means when said sensor bar is in said first position to move the items toward said take-off means until at least one item engages and moves said sensor bar to said second position.

42. An apparatus as defined in claim 41 wherein said coordinating means further includes biasing means for biasing said sensor bar into said first position, wherein said coordinating means activates said take-off means to remove the at least one item engaging said sensor bar from said feed bed and into the production stream when said sensor bar is in said second position, and wherein said biasing means functions to move said sensor bar to said first position once the at least one item is disengaged from said sensor bar due to removal by said take-off means.

43. An apparatus as defined in claim 42 wherein said biasing means includes a biasing weight which is operatively associated with said sensor bar so that the force of gravity acting on said biasing weight biases said sensor bar into said first position.

44. An apparatus as defined in claim 43 wherein said coordinating means further includes an optical sensor which senses when said sensor bar is and is not in said second position.

45. A debagging apparatus comprising:

a support adapted to receive and support at least one item encased within a bag having a sealed flap;

engaging means for pulling the flap outwardly away from the bag;

cutting means for cutting the bag adjacent the flap to open the bag; and coordinating means for coordinating said cutting means with the pulling of said engaging mans, said coordinating means including sensor means for sensing when the flap is pulled away from the bag and means for activating said cutting means when said sensor means senses the pulling of the flap, said sensor means comprising a sensor bar movable between first and second positions and bias means for biasing said sensor bar in said first position, wherein said engaging means pulls the bag against said sensor bar, when it pulls the flap, and moves said sensor bar to said second position, wherein said sensor bar stops said items when at said second position to create a taut portion in the bag between the flap and the items, and wherein said activating means activates said cutting means when said sensor is at said second position.

46. A debagging apparatus as defined in claim 45 further including removal means for holding at least one item on said support when the bag is removed from the item.

47. A debagging apparatus as defined in claim 46 in which said removal means includes an abutment opposite said engaging means, wherein said abutment defines an opening through which the bag can be pulled from the at least one item, and wherein said abutment abuts the item and prevents the item from being pulled through said opening with the bag.

* * * * *